US011235370B2

(12) United States Patent
Staten et al.

(10) Patent No.: US 11,235,370 B2
(45) Date of Patent: Feb. 1, 2022

(54) PUNCH ASSEMBLY WITH INTERCHANGEABLE TIPS

(71) Applicant: E&S Enterprises Inc., Indianapolis, IN (US)

(72) Inventors: Douglas Paul Staten, Indianapolis, IN (US); Donald Carl Edwards, Martinsville, IN (US)

(73) Assignee: E&S Enterprises Inc., Indianapolis, IN (US)

( * ) Notice: Subject to any disclaimer, the term of this patent is extended or adjusted under 35 U.S.C. 154(b) by 11 days.

(21) Appl. No.: 16/377,619

(22) Filed: Apr. 8, 2019

(65) Prior Publication Data

US 2020/0316670 A1 Oct. 8, 2020

(51) Int. Cl.
*B21D 37/12* (2006.01)
*B21D 22/02* (2006.01)
(Continued)

(52) U.S. Cl.
CPC ..... *B21D 37/12* (2013.01); *B21D 22/02* (2013.01)

(58) Field of Classification Search
CPC .. B21D 5/0209; B21D 5/0254; B21D 5/0236; B21D 5/0218; B21D 5/02; B21D 37/12;
(Continued)

(56) References Cited

U.S. PATENT DOCUMENTS 3,782,166 A 1/1974 Whistler et al.
5,638,727 A * 6/1997 Gringer ..... B25G 1/085 81/438
(Continued)

FOREIGN PATENT DOCUMENTS

DE 2608159 A1 * 9/1977 ..... B21D 5/0209
EP 1321200 A2 6/2003
(Continued)

OTHER PUBLICATIONS

Mate Precision Tooling, American Precision Style Press Brake Tooling, Mate Precision Tooling (Year: 2018).*
(Continued)

*Primary Examiner* — Jimmy T Nguyen
*Assistant Examiner* — Mohammed S. Alawadi
(74) *Attorney, Agent, or Firm* — Maginot, Moore & Beck, LLP

(57) ABSTRACT

A punch assembly with interchangeable tips includes a punch body and a punch tip releasably coupled to the punch body. The punch body includes a proximal end, a distal end opposite the proximal end, and a cross-sectional shape defined between the proximal end and the distal end. The proximal end includes a flange configured to engage a punch holder. The distal end includes a distal surface defining a lateral direction. The punch tip is coupled to the distal end of the punch body via a magnetic coupling provided by a plurality of magnets. The punch tip includes a working surface and a coupling member. The distal end of the punch body engages the coupling member of the punch tip in a tongue-in-groove arrangement wherein the plurality of magnets are provided within a tongue and cupped within a groove.

20 Claims, 12 Drawing Sheets

(51) Int. Cl.
*B21D 37/02* (2006.01)
*B21D 5/02* (2006.01)

(58) Field of Classification Search
CPC ..... B21D 37/04; B21D 22/02; B21D 28/02; B21D 28/24; B21D 28/246; B21D 28/346; B21D 37/08; B21D 37/10; B21D 37/14; B23B 31/28; Y10T 279/23; B25B 27/14; B25B 11/002; B25B 23/12; B23C 5/22; B23C 2210/16
USPC ..... 72/389.3, 289.4, 482.9
See application file for complete search history.

(56) References Cited

U.S. PATENT DOCUMENTS

| | | | | |
|---|---|---|---|---|
| 6,948,889 | B2 * | 9/2005 | Arvidsson | B23C 5/06 407/113 |
| 7,401,491 | B2 | 7/2008 | Leland | |
| 8,322,181 | B2 | 12/2012 | Wilson | |
| 8,752,410 | B2 | 6/2014 | Rogers et al. | |
| 9,975,161 | B2 | 5/2018 | Sato | |
| 10,391,566 | B2 * | 8/2019 | Hecht | B25F 1/00 |
| 2006/0048623 | A1 | 3/2006 | Schneider | |
| 2007/0056348 | A1 * | 3/2007 | Leland | B21D 37/02 72/481.1 |
| 2008/0295566 | A1 | 12/2008 | Hansen | |
| 2011/0247389 | A1 * | 10/2011 | Rouweler | B21D 5/0209 72/389.3 |
| 2011/0296969 | A1 | 12/2011 | Lenzotti | |
| 2013/0019650 | A1 * | 1/2013 | Rogers | B21D 5/0209 72/389.3 |
| 2015/0202751 | A1 * | 7/2015 | Chen | B25B 23/0057 279/9.1 |
| 2016/0228936 | A1 | 8/2016 | Villeneuve et al. | |
| 2017/0312800 | A1 | 11/2017 | Fischereder et al. | |
| 2018/0071805 | A1 | 3/2018 | Sundquist et al. | |
| 2018/0304331 | A1 | 10/2018 | Cavicchia et al. | |
| 2019/0001387 | A1 * | 1/2019 | Sundquist | B21D 5/0236 |

FOREIGN PATENT DOCUMENTS

| | | | |
|---|---|---|---|
| EP | 1479461 | A1 | 11/2004 |
| FR | 2791590 | A1 | 10/2000 |
| JP | 10258329 | A | 9/1998 |
| JP | 2003117607 | A | 4/2003 |
| WO | 2013119380 | A1 | 8/2013 |
| WO | 201871946 | A2 | 4/2018 |

OTHER PUBLICATIONS

DE 2608159, Machine Translation, Sep. 1977 (Year: 1977).*
International Search Report and Written Opinion in corresponding application PCT/US2020/026894, dated Jul. 27, 2020.

* cited by examiner

PUNCH ASSEMBLY WITH INTERCHANGEABLE TIPS

FIELD

The present disclosure generally relates to the field of bending systems, and particularly to tools and components for press brakes and other sheet forming tools.

BACKGROUND

Manufacturers commonly bend, shape, and cut workpieces with machine presses, press brakes, and punch presses. These, and other force engines, are collectively referred to herein as "presses". As shown in FIG. 1A, a press 10 typically includes a ram 12, such as a hydraulic ram, configured to move relative to a bed 14. The ram 12 usually moves along a vertical axis or horizontal axis toward and away from the bed 14, as noted by arrows 16. Conventionally, presses 10 shape workpieces with a set of tools that may be coupled to the ram 12 and the bed 14. The press 10 of FIG. 1A includes an upper tool in the form of a punch assembly 20 including a punch 24 retained within a punch holder 22. The punch holder 22 is coupled to the ram 12. The press 10 of FIG. 1A further includes a lower tool in the form of a die 18 coupled to or retained within the bed 14. Exemplary workpieces that may be cut, bent, or otherwise formed include sheet metal and other industrial materials.

With reference now to FIGS. 1A and 1B, the press 10, having the vertically displaceable ram 12, bends a workpiece 26 (see FIG. 1B) according to the following exemplary forming process. First, the ram 12 is lifted to an elevated position. Next, the workpiece 26 is placed on the press 10 between the punch 24 and the die 18. After the workpiece 26 is properly positioned, the ram 12 is released from the elevated position. Releasing the ram 12 initiates a downstroke of the press 10 in a press direction (as indicated by arrows 16) so that the ram 12 and the punch assembly 20 move toward the bed 14 and the die 18. As the ram 12 moves toward the bed 14, a surface on a distal end of the punch 24 presses the workpiece 26 against and/or into the die 18 to bend, shape, or form the workpiece. At the completion of the downstroke, the ram 12 is lifted again to the elevated position. The formed workpiece 26 may then be removed from the press 10 by either a user or a machine.

Depending on the end use and size of the workpiece 26, it may be desirable to use any of various differently shaped punches 24 in order bend the workpiece into a desired shape, and to a desired degree, at a desired location. The punch holder 22 releasably retains the punches 24 to allow the operator to exchange different punches in the punch holder 22 for different jobs. However, this process of exchanging punches in and out of the punch holder is time consuming, resulting in increased manufacturing time and cost for each part produced. Additionally, as punches are repeatedly used over time, the tip of the punch wears, resulting in a tool that no longer produces the desired shape. When a punch no longer serves its intended purpose, it must be disposed of and replaced. The cost of repeatedly replacing punches over time further drives up manufacturing costs and time.

In view of the foregoing, it would be desirable to provide a punch assembly for a press that is durable and many be used to provide numerous different shapes. It would be advantageous if such a punch could be used for many different jobs and in association with various workpieces. It would be of further advantage if such a punch could be produced economically and used repeatedly without the need for periodic replacement.

SUMMARY

In at least one embodiment of the disclosure, a punch set includes a plurality of punch bodies, a plurality of magnets, and a plurality of interchangeable punch tips. Each punch body includes a proximal end, a distal end opposite the proximal end, and a cross-sectional shape defined between the proximal end and the distal end. The proximal end includes a flange configured to engage a punch holder. The distal end defines a distal surface elongated in a lateral direction. A press direction is defined perpendicular to the lateral direction and the distal surface. The cross-sectional shape of each punch body is different than the cross-sectional shape of other of the plurality of punch bodies within the punch set. The plurality of magnets are embedded in the distal end of each punch body. The plurality of punch tips are configured to interchangeably and releasably engage the distal end of each punch body. Each punch tip includes a working surface and an opposing groove. The groove on the tip is configured to receive the distal end of one of the punch bodies such that opposing walls of said groove extend past the plurality of magnets embedded in said punch body and such that the plurality of magnets are cupped within the groove when the distal end of said punch body is in said groove. The working surface of each punch tip is defined by a shape. The shape of the working surface of each punch tip is different than the shape of the working surface of other of the other punch tips.

In another embodiment of the disclosure, a punch assembly with interchangeable tips includes a punch body and a punch tip releasably coupled to the punch body. The punch body includes a proximal end, a distal end opposite the proximal end, and a cross-sectional shape defined between the proximal end and the distal end. The proximal end includes a flange configured to engage a punch holder. The distal end includes a distal surface elongated in a lateral direction, wherein a press direction is defined perpendicular to the lateral direction. The punch tip is coupled to the distal end of the punch body via a magnetic coupling provided by a plurality of magnets. The punch tip includes a working surface and a coupling member. The distal end of the punch body engages the coupling member of the punch tip in a tongue-in-groove arrangement, wherein the plurality of magnets are provided within a tongue and cupped within a groove of the tongue-in-groove arrangement.

In yet another embodiment, a method is disclosed for bending a workpiece. The method comprises securing a punch body to a punch holder, the punch body including a proximal end and a distal end opposite the proximal end, the distal end defining a distal surface elongated in a lateral direction, wherein a press direction is defined perpendicular to the lateral direction and the distal surface. The method further comprises magnetically coupling a first punch tip to the distal end of the punch body using a plurality of magnets, the first punch tip having a working surface and an opposing coupling member. Thereafter, the punch body and the coupled first punch tip is moved in the press direction such that the working surface of the first punch tip engages a workpiece. The first punch tip and the workpiece is then forced into a die in the press direction such that the first punch tip bends the workpiece within the die. Next, the punch body and the coupled first punch tip is moved in a direction opposite the press direction such that the working surface of the first punch tip disengages the workpiece. The method further comprises removing the first punch tip from the punch body in order to de-couple the first punch tip from the punch body. Additionally, the method comprises magnetically coupling a second punch tip to the distal end of the punch body, the second punch tip having a working surface and an opposing coupling member.

The above described features and advantages, as well as others, will become more readily apparent to those of ordinary skill in the art by reference to the following detailed description and accompanying drawings. While it would be desirable to provide a method and system for a punch assembly with interchangeable tips that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

DESCRIPTION

Figure 1A:
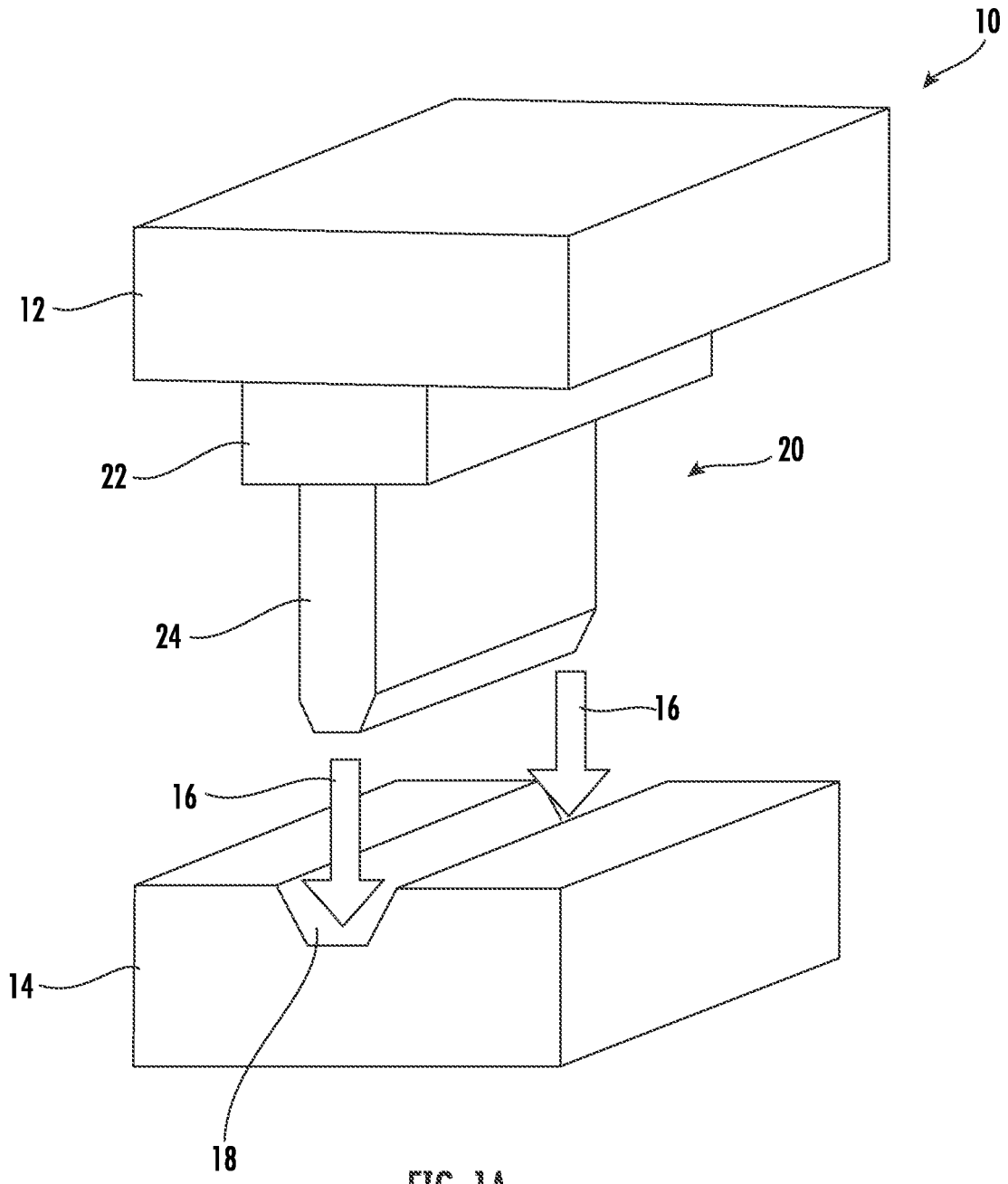
FIG. 1A (PRIOR ART)
FIG. 1A shows a perspective view of a prior art press including a punch assembly and a die.

A punch set is disclosed herein including a plurality of punch bodies and a plurality of interchangeable tips. A plurality of magnets are used to retain the interchangeable tips on the punch bodies. The magnets allow for a releasable magnetic coupling between each of the plurality of interchangeable tips and the plurality of punch bodies. The coupling between the punch body and the interchangeable tip is standard such that each of the interchangeable tips may be coupled to each of the punch bodies. Accordingly, the user may select any combination of tip and punch body within the set to form a punch assembly.

With reference now to FIGS. 2-5, a punch assembly 30 is shown. The punch assembly 30 includes a punch body 40, a plurality of magnets 60, and a plurality of interchangeable tips 70. The punch body 40 is generally a solid, prism-like structure defined by a cross-sectional shape 46 that extends from a left side 50 to a right side 52 of the structure. The punch body 40 is comprised of a relatively strong, hard, ferromagnetic material, such as steel, and is thus capable of withstanding the forces typically produced by the press without deformation of the punch body itself.

The punch body 40 has a uniform cross-sectional shape at all locations on from the left side 50 to the right side 52 of the punch body. The cross-sectional shape 46 of the punch body 40 may be any of various shapes, including polygons or polygon-like shapes. In the embodiment of FIGS. 2-5, the cross-sectional shape is an irregular polygon-like shape that includes at least one curved surface, but those of ordinary skill in the art will recognize that any of various other shapes are possible and contemplated for other punch bodies. Moreover, in at least some embodiments of the punch body 40, the punch body may not have a uniform cross-sectional shape from the left side to the right side of the structure, but may instead have some irregularities that are designed to produce special bends in workpieces when used in association with a press.

Figure 1B:
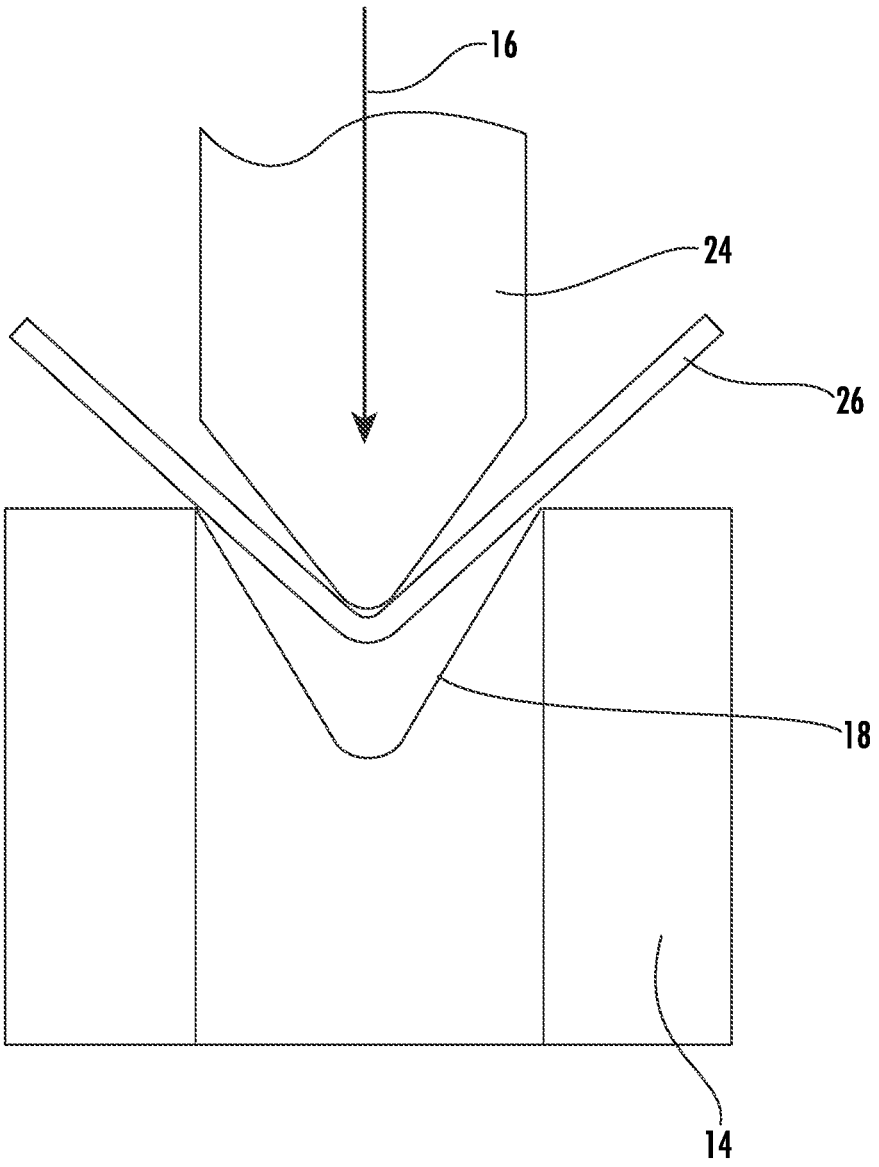
FIG. 1B (PRIOR ART)
FIG. 1B shows a side view of the punch and die of FIG. 1A with a workpiece positioned therebetween.

Each punch body 40 is further defined by a proximal end 42 (which may also be referred to herein as an "upper" end) and an opposite distal end 44 (which may also be referred to herein as a "bottom" end). The proximal end 42 of the punch body 40 includes an upper flange 48 configured to engage a punch holder on a punch press (e.g., see the punch press 10 of FIGS. 1A and 1B). In the embodiment of FIGS. 2-5, the flange 48 is provided by a linear rib structure that projects outwardly from an otherwise flat upper surface on the proximal end 42 of the punch body 40. The flange 48 extends laterally from a left side 50 to a right side 52 of the punch body 40. The flange 48 is positioned slightly offset from the front edge of the punch body such that it is substantially aligned in the vertical direction (noted by arrow 62) with the distal end 44 of the punch body 40. The structure of the flange 48 is such that a punch holder may clamp onto the flange 48 and fixedly retain the punch body 40 in place upon the press. The punch holder is configured to both retain the flange 48 and translate a downward force from the punch press upon the flange 48 and the upper surface of the punch body 40 located on opposite sides of the flange. While the flange 48 is shown in FIGS. 2-5 as being a linear rib structure that extends laterally across the proximal end 42 of the punch body 40, it will be recognized that other embodiments, the flange 48 may be configured differently, as will be recognized by those of ordinary skill in the art.

The distal end 44 of the punch body 40 is provided by a rectangular prism-like structure with two opposing vertical surfaces 54 and a distal surface in the form of a flat, rectangular bottom surface 56. The vertical surfaces 54 include a front rectangular surface 54*a* and a rear rectangular surface 54*b*, each of which extend downwardly and terminate at the bottom surface 56. The vertical surfaces 54*a* and 54*b* provide a projecting lip or tongue on the distal end 44 of the punch body 40 that is generally aligned with the upper flange 48 in the vertical direction on the punch body 40. In the embodiment of FIGS. 2-5, the vertical surfaces 54*a* and 54*b* are flat and parallel, but it will be recognized that in some embodiments, the vertical surfaces 54*a* and 54*b* may be angled and/or include surface features. For example, the vertical surfaces 54*a* and 54*b* may be substantially vertical (e.g., between 60 and 90 degrees) and/or may include a linear groove.

The opposing vertical surfaces 54*a* and 54*b* of the distal end 44 terminate at the rectangular bottom surface 56. The bottom surface 56 is a distal surface on the punch body 40 and is elongated in the lateral direction (i.e., from the left side 50 to the right side 52 of the punch body). The vertical direction 62 (i.e., the press direction) is defined perpendicular to the lateral direction and a plane in which the flat bottom surface 56 resides. The bottom surface 56 is the surface on the punch body 40 that is configured to apply a downward force. As explained in further detail below, when the punch body 40 is used in association with one of the interchangeable tips 70, the bottom surface 56 of the punch body actually applies the downward force to the associated tip 70.

Figure 3:
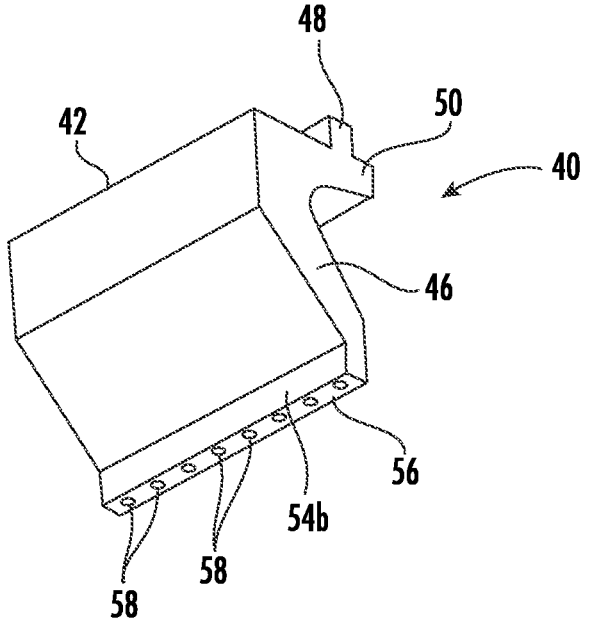
FIG. 3 shows a bottom perspective view of the punch body of the punch assembly of FIG. 2.
Figure 5:
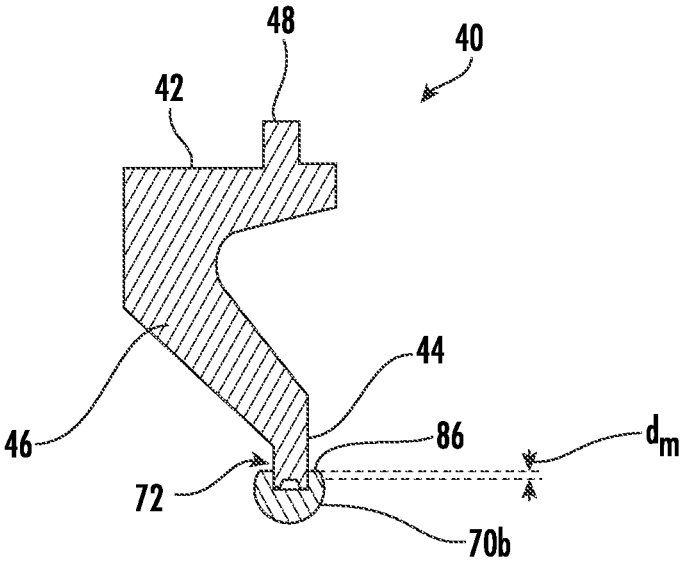
FIG. 5 shows a cross-sectional view of the punch and tip through plane V-V of FIG. 4.

As best shown in FIGS. 3 and 5, a plurality of equally spaced bores 58 or other holes are formed in the distal end 44 of the punch body 40 with bore openings provided in the rectangular bottom surface 56. The bores 58 are aligned in a single left-to-right row on the distal end 44 of the punch body 40, with such row being centered between the front side and the back side of the punch body. Additionally, the leftmost and rightmost bores are positioned close to the left and right edges of the bottom surfaces 56. The magnets 60 are inserted into each of the bores 58. The magnets 60 are capable of retaining one of the interchangeable tips 70 in place on the distal end 44 of the punch body 40. With the bores 58 and associated magnets 60 regularly spaced across a substantial entirety of the bottom surface 56, the attraction of the tip 70 to the punch body is substantially constant from the left side to the right side across the entire tip 70.

The magnets 60 are slightly smaller in diameter than the bores 58, but substantially fill the space formed by the bores 58 when embedded therein. The magnets 60 are retained in place within the bores 58 by any of various means such as adhesives, epoxies, fasteners, friction fit, or other securing means, as will be recognized by those of ordinary skill in the art. The magnets may be any of various types of magnets having relatively strong magnetic properties, and capable of magnetically coupling the punch body 40 and one of the interchangeable tips. For example, the magnets are permanent magnets such as rare earth magnets, which are also known as neodymium magnets. However, it will be recognized that the magnets 60 may also be provided in other forms, such as other types of permanent magnets or electromagnets. Additionally, while the magnets 60 and bores 58 are shown in the embodiment of FIGS. 2-5 as being cylindrical in shape, it will be recognized that the magnets 60 and bores 58 may be differently shaped, such as cubes, rectangular prisms, or other shapes.

With particular reference again to FIG. 2, each of the interchangeable tips 70 is generally a cylindrical or prism-like structure defined by a groove 72 on a proximal side of the tip 70 and a working surface 82 on a distal side of the tip. Each tip 70 is further defined cross-sectional shape 80 that extends from a left side to a right side of the structure. Like the punch body 40, the interchangeable tips 70 are also comprised of a relatively strong, hard, ferromagnetic material, such as steel, and is thus capable of withstanding the forces typically produced by the press without deformation of the tip itself.

Figure 2:
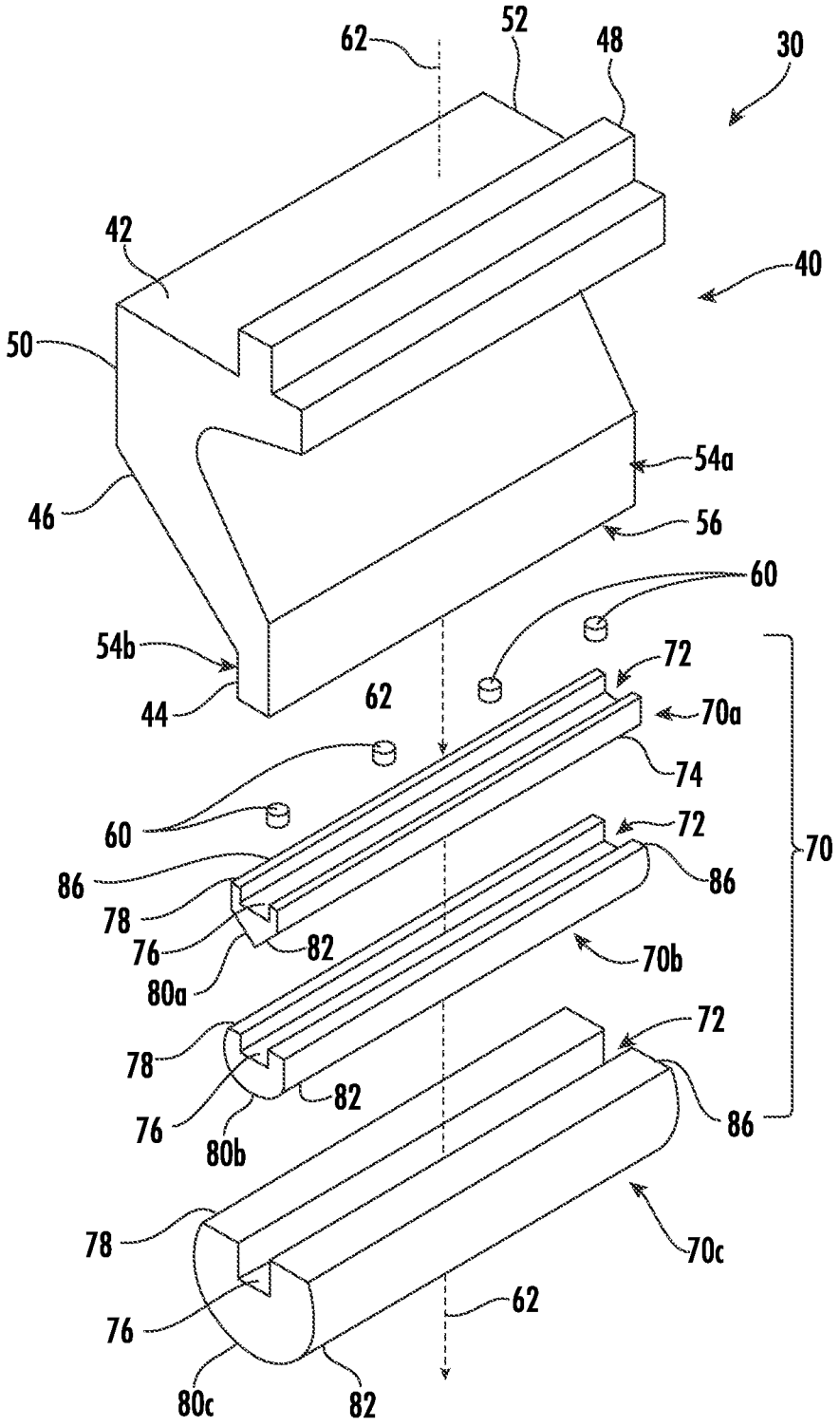
FIG. 2 shows an exploded perspective view of a punch assembly including a punch body and interchangeable tips.

The cross-sectional shapes 80 of the tips 70 may include any of various shapes, including polygons or polygon-like shapes, shapes with curved surfaces such as ovals or circles, or combinations of such shapes. As shown in FIG. 2, a first tip 70*a* has a generally triangular cross-sectional shape 80*a* including an angled portion with two legs extending therefrom and a recess formed between the two legs (i.e., see the left side of the tip 70*a*). A second tip 70*b* has a truncated circular or oval shape 80*b*, including a curved portion and a recess formed on an opposite side of the shape from the curved portion. A third tip 70*c* has another truncated circular or oval shape 80*c* with a larger radius or curved arc than the shape 80*b*, and a recess formed opposite the curved portion. When the cross-sectional shape 80 is translated across the structure from the left side to the right side, the recess is associated with the linear groove 72 formed on the tip 70, and the portion opposite the groove is associated the working surface 82 of the tip 70. Accordingly, the portion of each cross-sectional shape 80 that is associated with the groove 72 is a concave portion, and the portion of the cross-sectional shape that is associated with the working surface 82 is typically a convex portion.

Each groove 72 of a tip 70 is defined by a front wall 74, a bottom surface 76, and a rear wall 78. The shape of the groove 72 is complementary to the shape of the distal end 44 of the punch body 40 such that the distal end 44 of the punch body 40 fits into the groove 72. Accordingly, in the embodiment of FIGS. 2-5, the front wall 74 is parallel to the rear wall 78 and the bottom surface 76 extends therebetween, perpendicular to both the front wall 74 and the rear wall 78. The distance between the front wall 74 and the rear wall 78 is sufficient to allow the distal end 44 of the punch body 40 to be closely received within the groove 72. Furthermore, the depth of the groove 72, as defined by the height of the front wall 74 and rear wall 78 extending from the bottom surface 76 to an upper surface 86 of the front wall 74 or rear wall 78, is sufficient such that a significant portion of the distal end 44 of the punch body 40 may be inserted into the groove 72. For example, in at least some embodiments, the depth of the groove may be between 5 mm and 50 mm. The depth of the groove 72 may also be defined as a ratio relative to the overall height of the tip (e.g., the distance from the center of the working surface 82 to a line extending between the top of the front wall 74 and the rear wall 78). This ratio of the height of the tip 70 to the depth of the groove 72 may be, for example, between 2:1 and 4:1. In at least some embodiments, the height of the tip 70 to the depth of the groove 72 is about 3:1 (e.g., between 2.75:1 and 3.25:1). It has been determined that such a ratio provides good stability for the tip 70 when mounted on the distal end 44 of the punch body 40.

Figure 4:
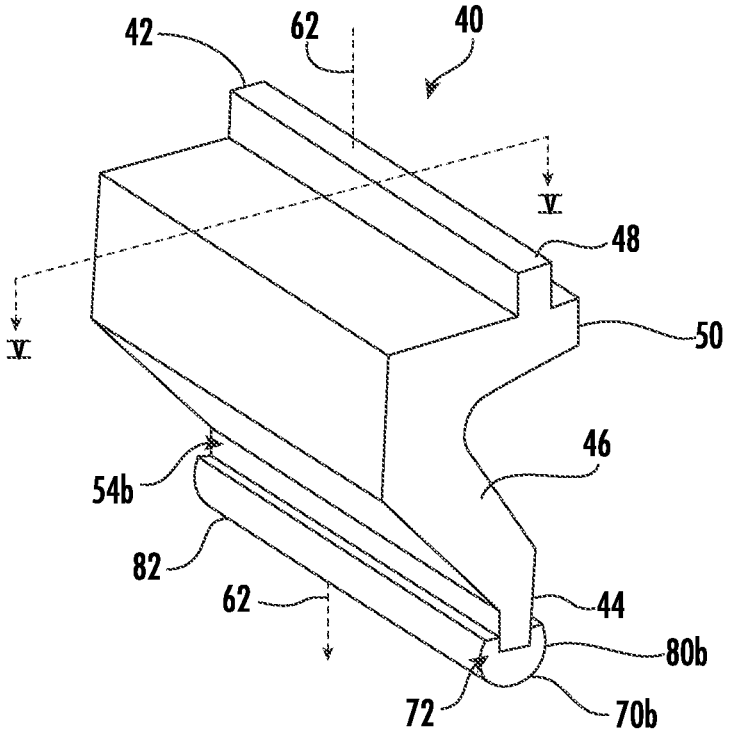
FIG. 4 shows a top perspective view of the punch assembly of FIG. 2 with a tip positioned on an end of the punch body.
Figure 6:
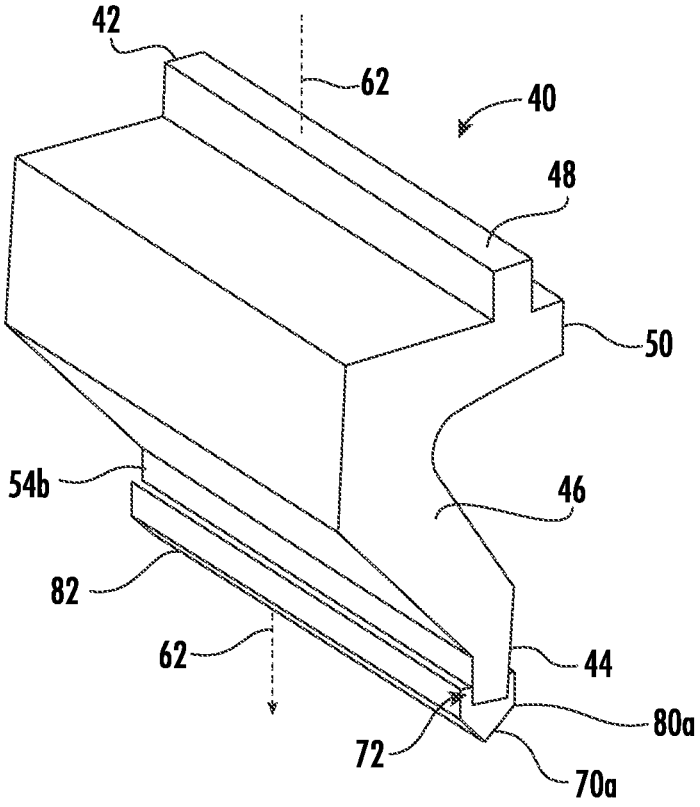
FIG. 6 shows a top perspective view of the punch body of FIG. 4 with an alternative tip positioned on the end of the punch.

The tips 70 are configured to interchangeably engage the distal end 44 of the punch body 40 via the grooves 72. Thus, each of the three tips 70*a*, 70*b*, and 70*c* is configured for placement on the punch body 40. FIGS. 4 and 5 show one of the interchangeable tips 70*b* mounted on the distal end 44 of the punch body 40. FIG. 6 shows a different tip 70*a* of the plurality of interchangeable tips mounted on the same punch body 40. Each of the various tips 70 typically have a significantly lesser height than the associated punch body 40 and are configured for mounting on the distal end 44 of the punch body. Accordingly, the height of each punch body 40 relative to each punch tip 70 in a set of punches and tips will typically fall within a range. For example, the height of a punch body relative to the punch tip for a given punch set is typically between 2.5:1 and 10:1. In at least one exemplary embodiment, the ratio of each punch body to each punch tip in a punch set is between 3.5:1 and 8:1.

When one of the tips 70 is mounted on punch body 40, the distal end 44 of the punch body 40 serves as a tongue that is received within the groove 72 of the tip 70*b* with the bottom surface 56 of the tongue engaging the bottom surface 76 of the groove 72. The opposing front wall 74 and rear wall 78 at the sides of the groove 72 extend upward, past the plurality of magnets 60 embedded in the punch body 40. As a result, the plurality of magnets 60 are cupped within the groove 72 when the distal end of said punch body is positioned in said groove 72 (i.e., as described below, the magnets 60 are below the top surface 86 of the walls defining of the groove 72). The working surface 82*b* of the tip 70*b* is opposite the groove 72 and faces downward. This configuration acts to secure the tip 70 and lock it in place on the punch body 40 (i.e., the tongue-in-groove configuration, wherein the bottom surface 56 of the punch body 40 engages the bottom surface 76 of the groove 72, and the opposing front wall 74 and rear wall 78 extend upward past the magnets 60 as they abut the vertical surfaces 54*a* and 54*b* on the distal end 44 of the punch body 40). Moreover, the magnets 60 provide magnetic forces that attract the tip 70 to the punch body 40 and further secure the tip 70 to the punch body 40. As shown in FIG. 5, when the distal end 44 of the punch body 40 is inserted into the groove 72 of the tip, an upper surface of each magnet 60 is a distance $d_m$ below the upper surface 86 of the tip 70 in which of the magnet 60 is positioned. The distance $d_m$ is greater than zero, and is typically between 1 mm and 20 mm, and helps to further secure the connection between the punch body 40 and the tip 70. In many embodiments the distance $d_m$ is between 3 mm and 6 mm.

Removal of an existing tip 70 from the punch body 40 involves simply pulling the existing tip downward or laterally away from the punch body with sufficient force to overcome the magnetic coupling between the magnets 60 and the tip 70. For example, sliding the tip 70 in the lateral direction such that the distal end 44 of the punch body 40 slides out of the side of the groove 72 will result in removal of the tip 70 from the punch body 40. Similarly, pulling the tip 70 downward will allow the tip 70 to be released from the magnets 60 with the punch body 40 exiting the top of the groove 72. Thereafter, a different tip 70 may be inserted on the punch body 40 in a similar manner.

Figure 7:
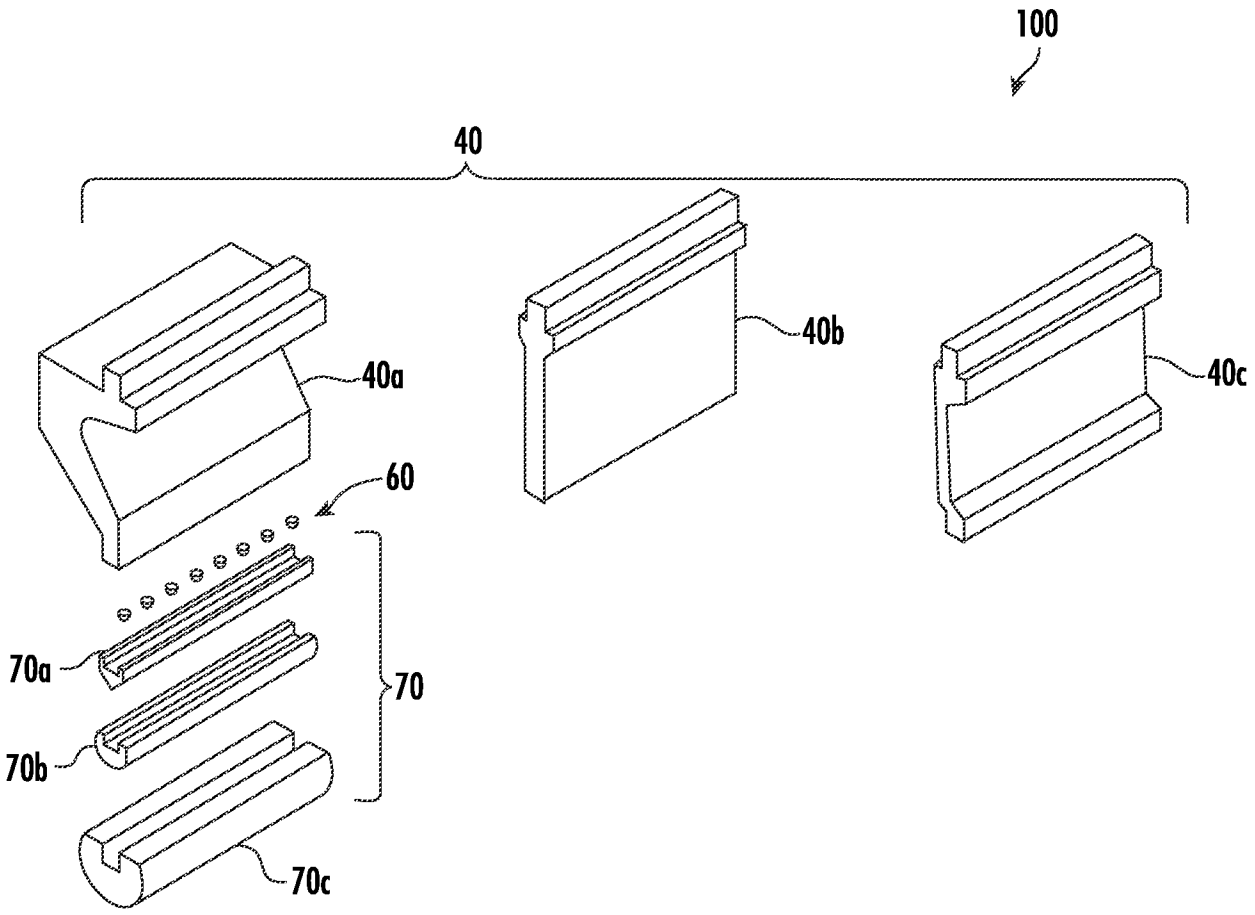
FIG. 7 shows an exploded perspective view of a punch set including a plurality of punches and a plurality of interchangeable tips, such as those of FIG. 2.

In addition to the plurality of interchangeable tips 70 being configured to mount on one punch body 40, it will also be recognized that a plurality of different punch bodies may be provided wherein each of the plurality of interchangeable tips is configured to mount on each of the punch bodies. FIG. 7 shows a punch set 100 including a plurality of differently shaped punch bodies 40*a*, 40*b*, 40*c*, and a plurality of differently shaped punch tips 70*a*, 70*b*, 70*c*. The operator of a punch press with access to the punch set 100 can advantageously use any combination of one of the punch bodies 40*a*, 40*b*, and 40*c* and one of the punch tips 70*a*, 70*b*, and 70*c* in order to form a punch assembly that is capable of producing a desired bend in a workpiece. Additionally, the operator can quickly and easily change punch tips on a given punch, and thus form a different bend in the workpiece with very little time spent adjusting the punch press for the different bend.

In operation, the punch set disclosed in FIGS. 2-7 allows the operator to use any combination of the punch bodies 40*a*, 40*b*, 40*c* and tips 70*a*, 70*b*, 70*c* in order to make a number of desired bends in a workpiece. Accordingly, a method is disclosed herein for bending a workpiece. The method begins when the operator secures one of the punch bodies 40*a*, 40*b*, 40*c* to the punch holder. The method continues when the operator selects a first one of the punch tips 70*a*, 70*b*, 70*c* and magnetically couples the selected punch tip to the distal end of the punch body using a plurality of magnets. Thereafter, the press is operated such that the punch body and the coupled first punch tip is moved in the press direction. As a result the working surface of the first punch tip engages a workpiece. The first punch tip and the workpiece is then forced into a die (e.g., a die such as the die 18 associated with the press 10 of FIGS. 1A and 1B) in the press direction such that the first punch tip bends the workpiece within the die. Subsequently, the punch body and the coupled first punch tip are moved in a direction opposite the press direction such that the working surface of the first punch tip disengages the workpiece. Next, the operator removes the first punch tip from the punch body in order to de-couple the first punch tip from the punch body. The operator then selects a second punch tip and magnetically couples the second punch tip to the distal end of the punch body. Operation of the press is then repeated in order to make a subsequent bend in the existing workpiece or another workpiece. Thereafter, differently shaped punch bodies and/or tips may be interchanged upon the press at the discretion of the operator to produce desired results. Advantageously, the operator can quickly and easily change punches and punch tips on a given punch, and thus form different bends in various workpiece with very little time spent adjusting the punch press and associated punch assembly.

Figure 8:
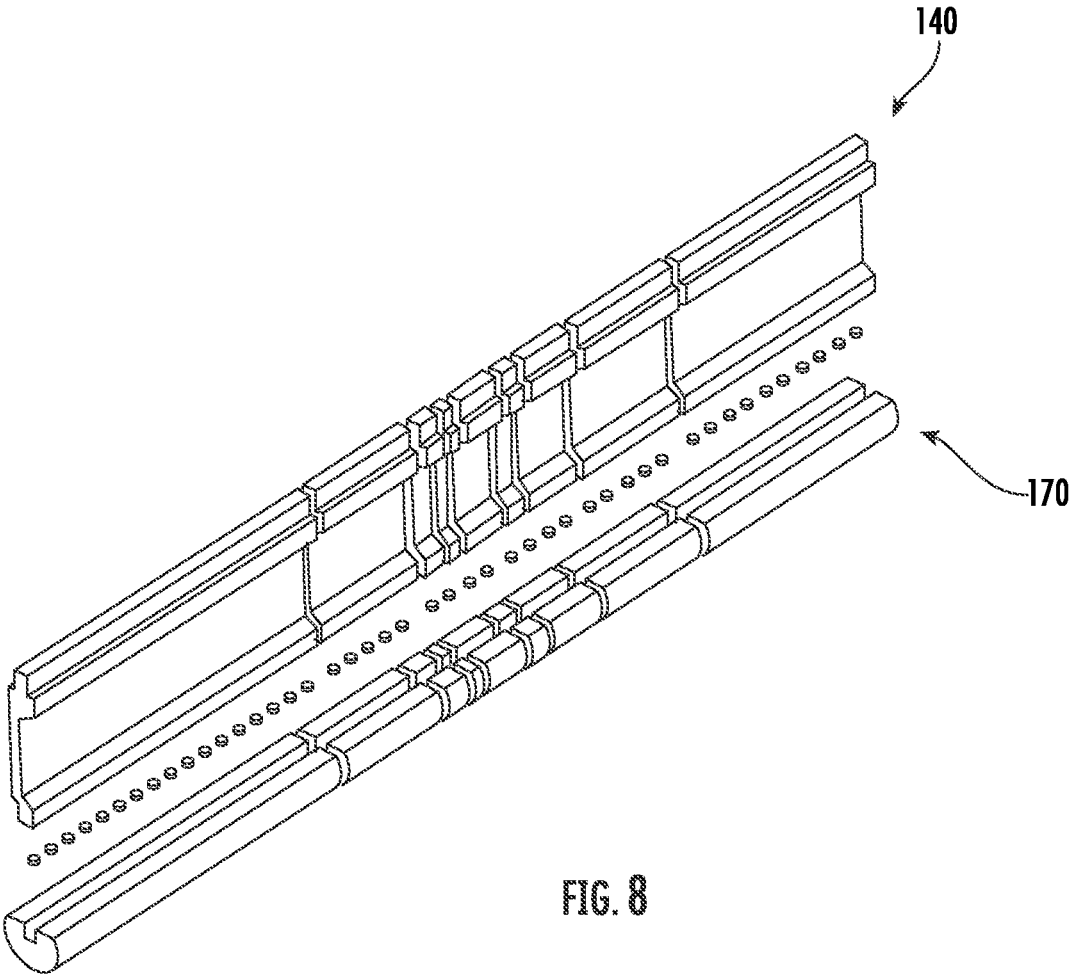
FIG. 8 shows a punch assembly including a series of differently sized punches with interchangeable tips.

With reference now to FIG. 8, in at least one alternative embodiment, the punch set 100 comprises a plurality of punch bodies 140 and punch tips 170, each having the same cross-sectional shape, but each having a different length (i.e., in the lateral direction, from left to right). The configuration of each punch body 140 and each punch tip 170 is similar to that described above in association with FIGS. 2-7. Each length of punch body 140 and the associated punch tip 170 of the same length may be referred to as a "punch section." Because each punch section has a different length, the operator may string together any number of punch sections by placing them side-by-side, thus allowing the user to arrive at a desired combined length for all of the punch sections. This provides the operator with the advantage of being able to produce bends of different lengths when working with various workpieces.

Figure 9:
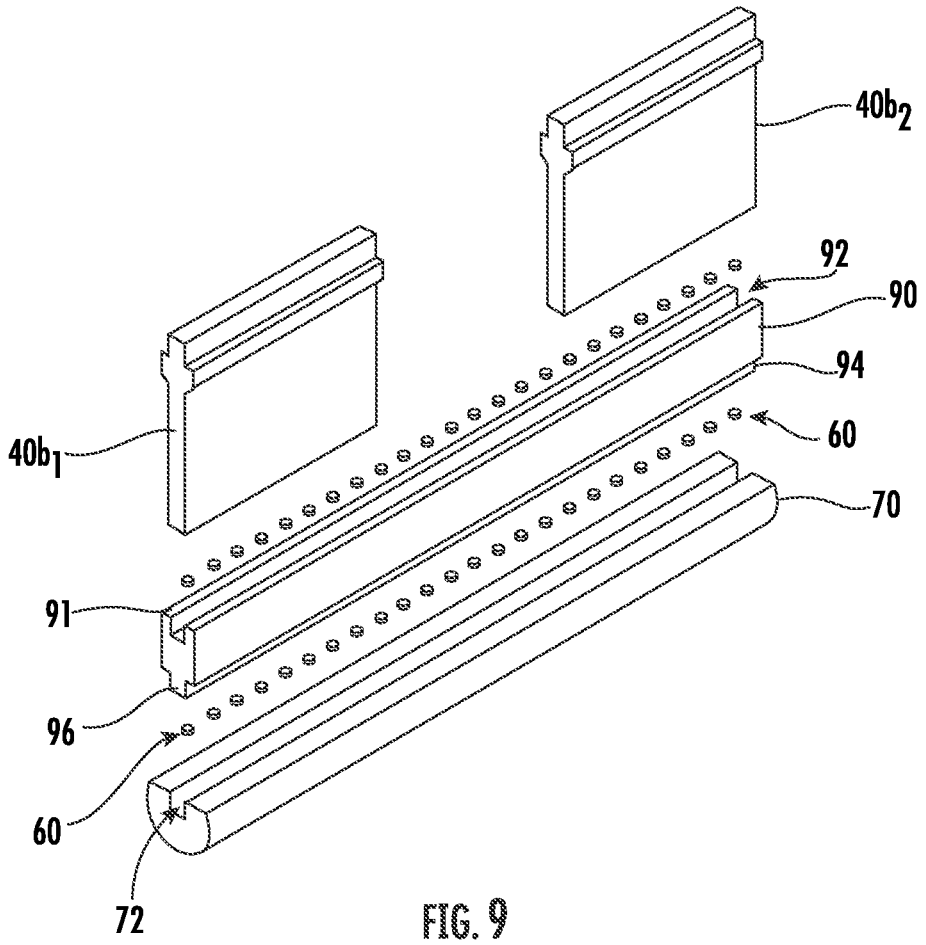
FIG. 9 shows a punch assembly including a pair of punches with a bridge and an interchangeable tip.

With reference now to FIG. 9, in at least one embodiment, the punch set 100 comprises a bridge 90 that extends between two different punch bodies $40b_1$, $40b_2$ that are separated by a lateral distance. The bridge 90 includes a proximal end 91 with a bridge groove 92, and a distal end 94 with a bridge tongue 96. The groove 92 on the bridge 90 is similar to the groove 72 of the tip, and the tongue 96 is similar to the tongue on the distal end of one of the punch bodies 40. Accordingly, the bridge 90 serves as an adaptor that allows two spaced apart punch bodies 40$b_1$ and 40$b_2$ to receive an elongated tip 70. The groove 92 on the proximal end 91 of the bridge 90 is configured to receive the tongues on the distal ends of a plurality of punch bodies (e.g., 40$b_1$ and 40$b_2$ as shown in FIG. 9) in a magnetic coupling arrangement, similar to that described previously in association with the embodiment of FIGS. 2-7. The bridge 90 also includes a plurality of magnets 60 disposed in bores (not shown) formed in the tongue 96 on the distal end 94 of the bridge 90. The tongue 96 on the distal end of the bridge 90 is configured to be received in the groove 72 on the tip 70. The bridge 90 allows two punch bodies 40$b_1$ and 40$b_2$ to be spaced apart while providing additional support for a tip 70 spanning between the two punch bodies 40$b_1$ and 40$b_2$. This arrangement is particularly beneficial for longer bends to be made in a workpiece because two shorter punch bodies 40$b_1$ and 40$b_2$ may be used in lieu of a longer punch body. The bridge 90 may also be used interchangeably with various differently shaped punches 40. Accordingly, the bridge 90 provides the punch set 100 with even more functionality without only one additional component instead of a number of longer punch bodies.

Although the various embodiments have been provided herein, it will be appreciated by those of skill in the art that other implementations and adaptations are possible. For example, while the magnets 60 and associated bores 58 are shown in the figures and described as being provided in the distal end of the punch body 40, it will be recognized that in at least some embodiments, the magnets 60 may be positioned in the tips 70 with openings to the bores 58 provided in the bottom surface 56 of the grooves 72.

As yet another example, while the tips 70 are shown herein as including a groove 72, in at least one alternative embodiment, the tips 70 may include a flange configured for insertion into a groove on the bottom surface 56 of the punch body 40. In such embodiment, the magnets 60 may be embedded in the flanges of the tips such that the magnets are cupped within the groove on the bottom surface 56 of the punch body.

As still another example of an alternative embodiment, while the tips 70 have been described herein as having a linear rectangular groove, in at least some embodiments, the tongue-in-groove relationship between the distal end of the punch body 40 and the grooves 72 of the tips may be differently configured, such as a dovetail tongue and groove, or multiple tongue and groove arrangements between each punch body 40 and each tip 70. In these and other embodiments, no magnets may be used in the coupling arrangement between the punch body 40 and the tips 70, and the coupling arrangement may be dependent completely on the shape of the coupling.

Figure 10A:
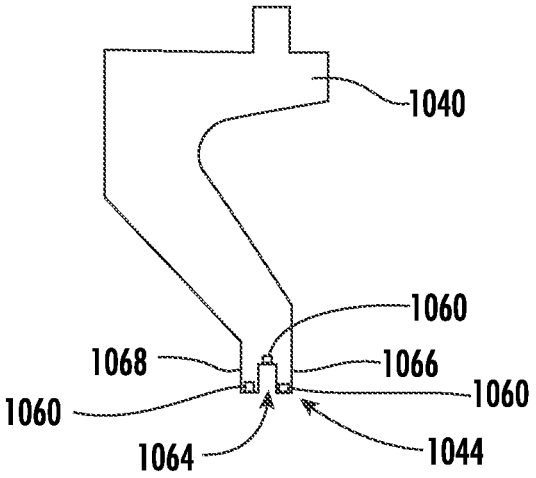
FIG. 10A shows an alternative embodiment of the punch body of FIGS. 2-6.
Figure 10B:
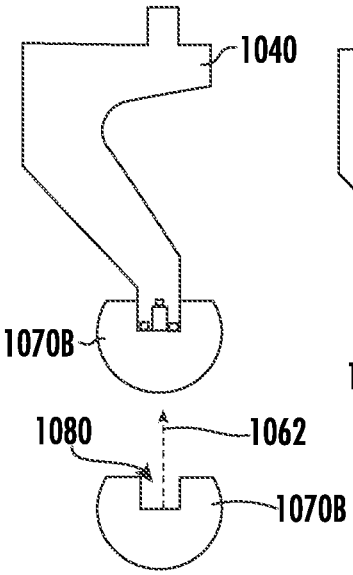
FIG. 10B shows the punch body of FIG. 10A with a first interchangeable tip.
Figure 10C:
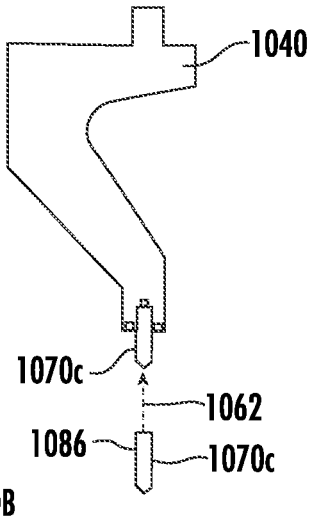
FIG. 10C shows the punch body of FIG. 10A with a second interchangeable tip.
Figure 10D:
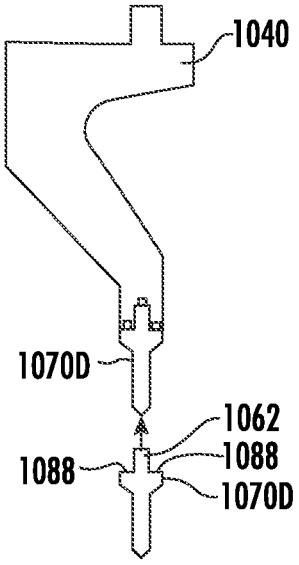
FIG. 10D shows the punch body of FIG. 10A with a third interchangeable tip.

With reference now to FIGS. 10A-13D, four different alternative embodiments of a punch body and interchangeable punch tips are shown. In each of these embodiments, the coupling arrangement between the punch body and the punch tips is different. FIG. 10A shows a punch body 1040 wherein a lateral groove 1064 is formed on the distal end 1044 of the punch body 1040. The lateral groove 1064 is defined between two opposing walls 1066 and 1068 that extend in the lateral direction. Magnets 1060 are embedded in the distal end of each of the opposing walls 1066 and 1068 as well as the base of the groove (i.e., within a hole formed in the surface defining the proximal side of the groove). The lateral groove 1064 allows the punch body to be used with an even greater number of interchangeable tips. For example, as shown in FIG. 10B, a first interchangeable tip 1070B is shown with a truncated circular or oval shaped cross-section and a groove 1080 formed opposite the curved portion, similar to the tip 70*c* of FIG. 2. The groove 1080 is designed and dimensioned such that the opposing walls 1066 and 1068 of the punch body are received within the groove 1080 when the tip 1070B is aligned with and moved toward the punch body 1040 in the vertical direction as noted by arrow 1062. FIG. 10C shows another example of an interchangeable tip 1070C having a narrow, substantially rectangular cross-section with a small curvature at the distal end of the tip 1070C. The depth of the tip 1070C is sufficiently thin such that a proximal end 1086 of the tip 1070C fits within the groove 1064 in the distal end 1044 of the punch body 1040. FIG. 10D shows a tip 1070D that is similar to the thin rectangular tip of FIG. 10C, but further includes two opposing shoulders 1088 designed and dimensioned to abut the distal end of the punch body 1040 and further stabilize the tip 1070D on the punch body 1040.

Figure 11A:
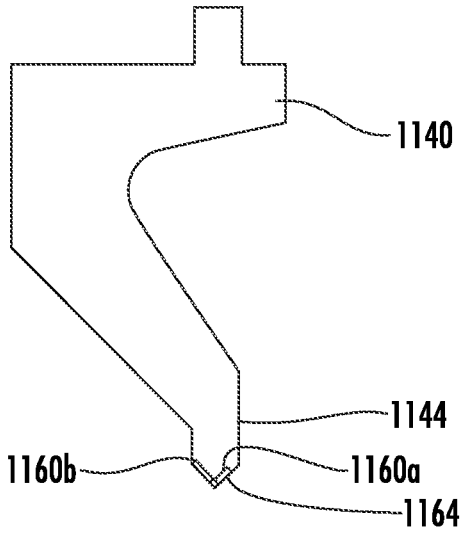
FIG. 11A shows another alternative embodiment of the punch body of FIGS. 2-6.
Figure 11B:
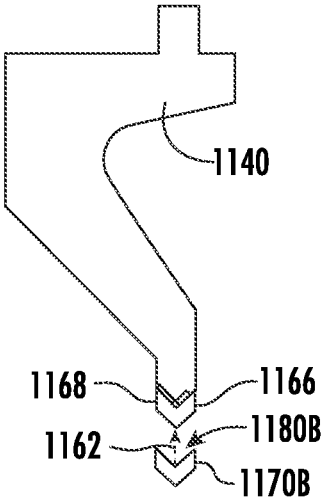
FIG. 11B shows the punch body of FIG. 11A with a first interchangeable tip.
Figure 11C:
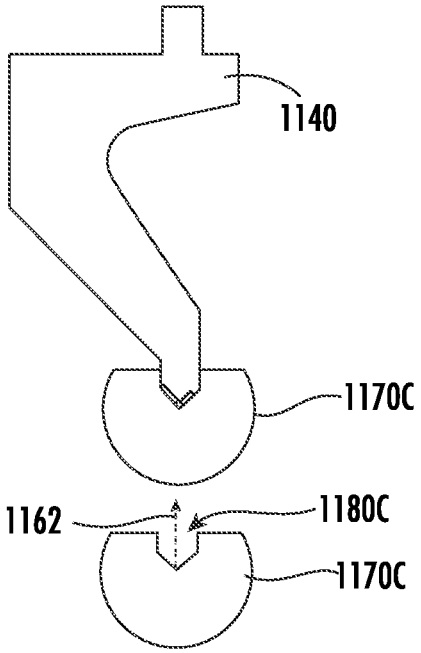
FIG. 11C shows the punch body of FIG. 11A with a second interchangeable tip.

With reference now to FIG. 11A a punch body 1140 is shown wherein the distal end 1144 of the punch body 1140 is tapered (i.e., the front and rear sides are angled inwardly and downwardly) to form a down-ward facing lateral ridge 1164. In other words, the cross-section of the ridge 1164 has an arrow-like shape pointing downward. Magnets 1160*a* and 1160*b* are provided on each side of the ridge 1164. The magnets are oriented at an angle relative to one another (e.g., at a ninety degree angle) with a group of first magnets 1160*a* aligned along the front side of the ridge 1164, and a group of second magnets 1160*b* aligned along the back side of the ridge 1164. As shown in FIG. 11B a first tip 1170B includes a groove 1180B that is complementary to the ridge 1164. Accordingly, the groove 1180B is configured to receive the ridge 1164 when the tip 1170B is aligned with and moved toward the punch body 1140 in the vertical direction as noted by arrow 1162. The tip 1170B is also relatively thin such that vertical walls 1166 and 1168 on the front and rear of the tip 1170B are aligned with the vertical walls on the distal end of the punch body 1140. As shown in FIG. 11C, a second tip 1170C has a truncated circular or oval shaped cross-section and a groove 1080C formed opposite the curved portion, similar to the tip 70*c* of FIG. 2. The groove 1180C is also complementary to the ridge 1164 and configured to receive the ridge 1164 therein.

Figure 12A:
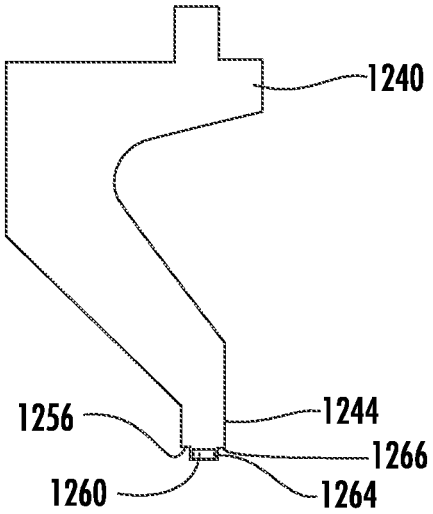
FIG. 12A shows yet another alternative embodiment of the punch body of FIGS. 2-6.
Figure 12B:
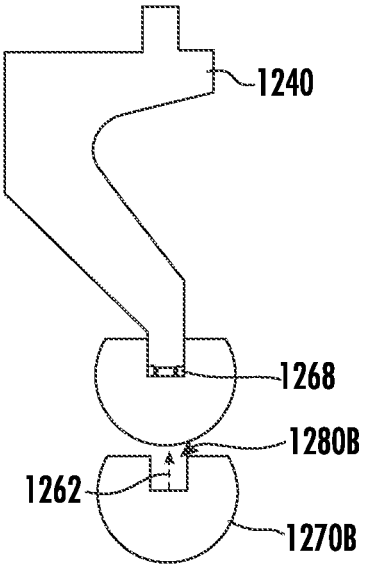
FIG. 12B shows the punch body of FIG. 12A with a first interchangeable tip.
Figure 12C:
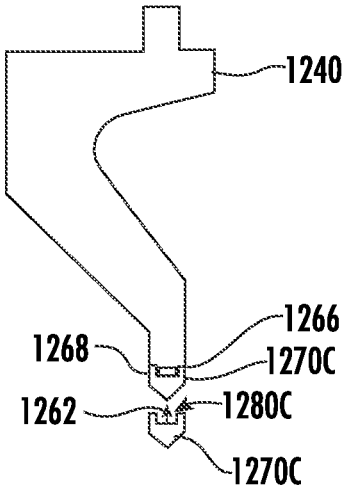
FIG. 12C shows the punch body of FIG. 12A with a second interchangeable tip.

With reference now to FIG. 12A, a punch body 1240 is shown wherein the distal end 1244 of the punch body 1140 includes a lateral rib 1264 formed along the bottom surface 1256 of the punch body 1240. Magnets 1260 are embedded in the distal end 1244 of the punch body 1240 and aligned in the lateral direction along the rib 1264. Shoulders 1266 are formed on the bottom surface 1256 of the punch body 1240 along opposite front and rear sides of the rib 1264. As shown in FIG. 12B, a first tip 1270B has a truncated circular or oval shaped cross-section and a rectangular groove 1280B formed opposite the curved portion, similar to the tip 70*c* of FIG. 2. The groove 1280B is configured to receive the distal end 1244 of the punch body 1240 as noted by arrow 1262. When the first tip 1270B is positioned on the distal end 1244 of the punch body 1240, air pockets 1268 are formed at the shoulder 1266 of the punch body 1240 at the front and rear sides of the rib 1264. FIG. 12C shows a second tip 1270C for use with the punch body 1240. The second tip 1270C includes a groove 1280C that is complementary to the rib 1264. Accordingly, the groove 1280C is configured to receive the rib 1264 when the tip 1270C is aligned with and moved toward the punch body 1240 in the vertical direction as noted by arrow 1262. The tip 1270C is also relatively thin such that vertical walls 1266 and 1268 on the front and rear of the tip 1270C are aligned with the vertical walls on the distal end of the punch body 1140.

Figure 13A:
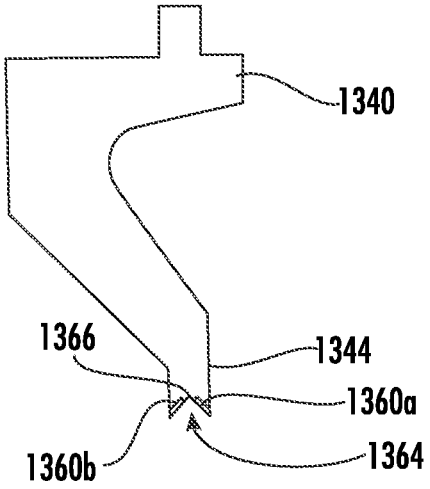
FIG. 13A shows a further alternative embodiment of the punch body of FIGS. 2-6.
Figure 13B:
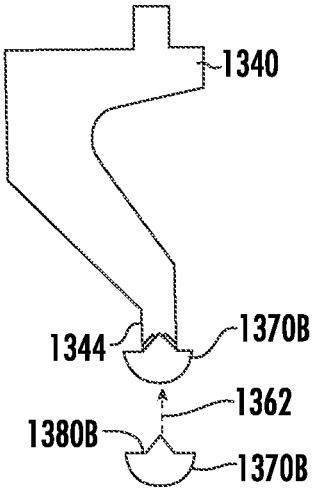
FIG. 13B shows the punch body of FIG. 13A with a first interchangeable tip.
Figure 13C:
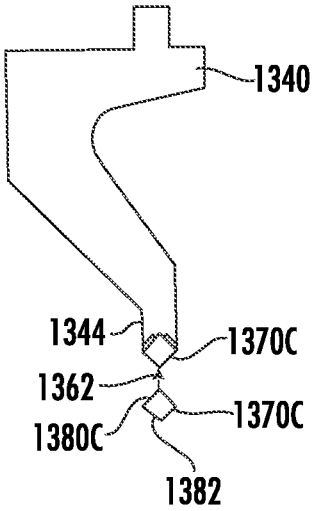
FIG. 13C shows the punch body of FIG. 13A with a second interchangeable tip.
Figure 13D:
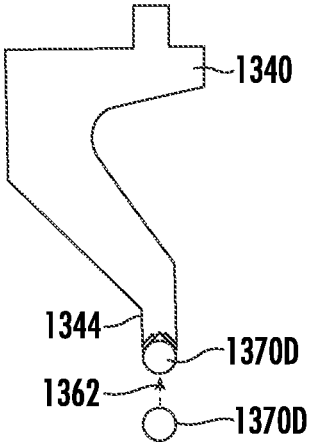
FIG. 13D shows the punch body of FIG. 13A with a third interchangeable tip.

With reference now to FIG. 13A, a punch body 1340 is shown wherein the distal end 1344 of the punch body 1340 includes an angled groove 1364. The front and rear sides of the groove 1364 are angled inwardly and upwardly and meet at an apex 1366. In other words, the cross-section of the groove 1364 has an arrow-like shape pointing upward. Magnets 1360*a* and 1360*b* are provided on each side of the ridge 1164. The magnets are oriented at an angle relative to one another (e.g., at a ninety degree angle) with a group of first magnets 1360*a* aligned along the front side of the groove 1364, and a group of second magnets 1360*b* aligned along the back side of the groove 1264. As shown in FIG. 13B a first tip 1370B has a truncated circular or oval shaped cross-section and a ridge 1380B formed opposite the curved portion. The ridge 1380B is complementary to the groove 1364 and configured to be inserted into and received by the groove 1364 when the tip 1370B is aligned with and moved toward the punch body 1340 in the vertical direction as noted by arrow 1362. FIG. 13C shows a second tip 1370C having a substantially square cross-sectional shape. Accordingly, the second tip 1370C is generally shaped as a rod-like structure having a substantially square cross-section. The tip 1370C includes a working surface 1382 that has a slightly rounded edge, and an opposite ridge 1380C. The ridge 1380C is complementary to the groove 1364 and configured to be inserted into and received by the groove 1364 when the tip 1370C is aligned with and moved toward the punch body 1340 in the vertical direction as noted by arrow 1362. FIG. 13D shows a third tip 1370D having a substantially round cross-section. Accordingly, the third tip 1370D is generally shaped as a rod-like structure having a substantially round cross-section. Any portion of the rod may serve as the working surface for the tip 1370D, and the opposite side of the tip is received within the groove 1364.

The foregoing are but a few of the possible alternative embodiments of the punch assembly with interchangeable tips described herein. It will be recognized that numerous additional embodiments are also possible. Furthermore, aspects of the various embodiments described herein may be combined or substituted with aspects from other features to arrive at different embodiments from those described herein. Thus, it will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A punch set comprising:

a plurality of punch bodies, each punch body including a proximal end, a distal end opposite the proximal end, and a cross-sectional shape defined between the proximal end and the distal end, the proximal end including a flange configured to engage a punch holder, the distal end defining a V-shaped distal surface elongated in a lateral direction along the punch body, the V-shaped distal surface including a front surface that is angled relative to a rear surface as defined by an angle between the front surface and the rear surface, wherein the angle defines a vertex that points in a press direction, the press direction defined along an axis extending from the proximal end to the distal end and perpendicular to the lateral direction, and wherein the cross-sectional shape of each punch body is different than the cross-sectional shape of other of the plurality of punch bodies;

a plurality of magnets embedded in the distal end of each punch body, the plurality of magnets including a plurality of front magnets arranged proximate the front surface and a plurality of rear magnets arranged proximate the rear surface of the V-shaped distal surface; and a plurality of punch tips configured to interchangeably and releasably engage the distal end of each punch body, each of the punch tips having a working surface and an opposing groove, the groove configured to receive the distal end of one of the punch bodies such that opposing walls of said groove extend past the plurality of magnets embedded in said punch body such that the plurality of magnets are cupped within the groove when the distal end of said punch body is in said groove, wherein the working surface of each punch tip is defined by a shape, and wherein the shape of the working surface of each punch tip is different than the shape of the working surface of other of the other punch tips.

2. The punch set of claim 1 wherein the magnets are rare earth magnets.

3. The punch set of claim 1 wherein each of the magnets are embedded in bores formed in the front surface and the rear surface of the distal end of each punch body, wherein the front surface and the rear surface are angled ninety degrees relative to one another.

4. The punch set of claim 3 wherein the bores are aligned in rows on the distal end of each punch body.

5. The punch set of claim 1 wherein a ratio of a height of each punch body to each punch tip is between 3:1 and 10:1.

6. The punch set of claim 1 wherein a ratio of a height of each tip to a height of the groove associated therewith is between 2:1 and 4:1.

7. The punch set of claim 1 wherein a distance defined between an upper surface of the magnets of one punch body and an upper surface of the opposing walls defining the groove of an associated tip in which said one punch body is inserted is between 1 mm and 20 mm.

8. The punch set of claim 1 wherein each punch body and each punch tip is comprised of steel.

9. The punch set of claim 1 further comprising a bridge including a bridge groove and a bridge tongue, the bridge having a lateral dimension that is greater than a lateral dimension of each punch body, the bridge configured to receive the distal end of each punch body in the bridge groove, and the bridge tongue configured to be received in the groove of each punch tip.

10. The punch set of claim 1 wherein the plurality of front magnets are arranged in alignment along the front surface, and wherein the V-shaped distal surface has a downward pointing vertex when said flange is engaged with said punch holder.

11. The punch set of claim 1 wherein the plurality of rear magnets are arranged in alignment along the rear surface, and wherein the V-shaped distal surface has an upward pointing vertex when said flange is engaged with said punch holder.

12. A punch assembly comprising:

a punch body including a proximal end, a distal end opposite the proximal end, and a cross-sectional shape defined between the proximal end and the distal end, the proximal end including a flange configured to engage a punch holder, the distal end includes a distal V-shaped surface elongated in a lateral direction along the punch body and formed by a front surface that is angled relative to a rear surface as defined by an angle between the front surface and the rear surface, the angle defining a vertex that points in a press direction defined along an axis that is perpendicular to the lateral direction; and a punch tip coupled to the distal end of the punch body via a magnetic coupling provided by a plurality of magnets, the punch tip having a working surface and a coupling member, the distal end of the punch body engaging the coupling member of the punch tip in a tongue-in-groove arrangement wherein the plurality of magnets are provided proximate the distal end such that the plurality of magnets are embedded in the tongue-in-groove arrangement.

13. The punch assembly of claim 12 wherein the plurality of magnets are permanent magnets.

14. The punch assembly of claim 12 wherein the plurality of magnets are embedded in bores formed in the distal end of each punch body.

15. The punch assembly of claim 12 wherein a ratio of a height of the punch body to the punch tip is between 3:1 and 10:1.

16. The punch assembly of claim 12 wherein a ratio of a height of the tip to a height of the groove is between 2:1 and 4:1.

17. The punch assembly of claim 12 wherein the punch body and the punch tip are comprised of steel.

18. The punch assembly of claim 12 wherein a distance defined between an upper surface of the magnets and an upper surface of the tip is between 1 mm and 20 mm.

19. A method of bending a workpiece comprising:

securing a punch body to a punch holder, the punch body including a proximal end and a distal end opposite the proximal end, the distal end defining a V-shaped surface elongated in a lateral direction and formed by a front surface that is angled relative to a rear surface as defined by an angle between the front surface and the rear surface, wherein the angle defines a vertex that points in a press direction that defines movement of the punch body along an axis that is perpendicular to the lateral direction;

magnetically coupling a first punch tip to the distal end of the punch body using a plurality of magnets, the first punch tip having a working surface and an opposing coupling member configured to engage the first punch tip in a tongue-in-groove arrangement, wherein a first set of the plurality of magnets are provided proximate the front surface of the distal end of the punch body and a second set of the plurality of magnets are provided proximate the rear surface of the distal end of the punch body such that the plurality of magnets are embedded in a tongue and cupped within a groove of the tongue-in-groove arrangement when the first punch tip is magnetically coupled to the distal end of the punch body;

moving the punch body and the coupled first punch tip in the a first press direction such that the working surface of the first punch tip engages a workpiece;

forcing the first punch tip and the workpiece into a die in the first press direction such that the first punch tip bends the workpiece within the die;

moving the punch body and the coupled first punch tip in a second press direction that is opposite the first press direction such that the working surface of the first punch tip disengages the workpiece;

removing the first punch tip from the punch body in order to de-couple the first punch tip from the punch body; and magnetically coupling a second punch tip to the distal end of the punch body, the second punch tip having a working surface and an opposing coupling member.

20. The method of claim 19 wherein the working surface of the second punch tip is shaped differently than the working surface of the first punch tip.

* * * * *